US009659522B2

(12) United States Patent
Jeon

(10) Patent No.: US 9,659,522 B2
(45) Date of Patent: May 23, 2017

(54) DISPLAY DRIVER, METHOD FOR DRIVING DISPLAY DRIVER, AND IMAGE DISPLAY SYSTEM

(71) Applicant: SAMSUNG DISPLAY CO., LTD., Yongin, Gyeonggi-Do (KR)

(72) Inventor: Jin Young Jeon, Cheonan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 137 days.

(21) Appl. No.: 14/475,899

(22) Filed: Sep. 3, 2014

(65) Prior Publication Data

US 2015/0062099 A1 Mar. 5, 2015

(30) Foreign Application Priority Data

Sep. 5, 2013 (KR) ..... 10-2013-0106725

(51) Int. Cl.
*G09G 3/06* (2006.01)
*G09G 3/20* (2006.01)

(52) U.S. Cl.
CPC ... *G09G 3/2096* (2013.01); *G09G 2320/0673* (2013.01); *G09G 2320/08* (2013.01); *G09G 2320/10* (2013.01)

(58) Field of Classification Search
CPC ..... G09G 2320/0673; G09G 2320/08; G09G 2320/10; G09G 3/2096
USPC ..... 345/99, 204, 213, 514, 690–691
See application file for complete search history.

(56) References Cited

U.S. PATENT DOCUMENTS 7,734,108 B2 * 6/2010 Oura ..... G09G 3/3611 345/30
9,019,188 B2 * 4/2015 Han ..... G09G 3/20 345/99
2002/0047847 A1 * 4/2002 Tamura ..... G09G 3/3611 345/534
2004/0207620 A1 * 10/2004 Ra ..... G09G 3/3406 345/213

(Continued)

FOREIGN PATENT DOCUMENTS

KR 10-2008-0026718 A 3/2008
KR 10-2009-0127696 A 12/2009

OTHER PUBLICATIONS

MIPI Alliance Specification for Display Serial Interface, Draft Version 1.01.00 Rel 11, Feb. 21, 2008.

(Continued)

*Primary Examiner* — Tony Davis
(74) *Attorney, Agent, or Firm* — Lee & Morse, P.C.

(57) ABSTRACT

A display driver includes a memory, a receiver, an image output unit, a controller, and an image mode selection unit. The memory stores a video signal. The receiver receives the video signal and a first control signal from a host processor, where the first control signal corresponds to the video signal. The image output unit processes the video signal stored in the memory and outputs the processed video signal to a display unit. The controller controls the image output unit based on an image mode to display an image corresponding to the video signal. The image mode selection unit detects the first control signal and a second control signal from the controller, and changes the image mode based on the first control signal and second control signal.

20 Claims, 5 Drawing Sheets

(56) References Cited

U.S. PATENT DOCUMENTS

| | | | | |
|---|---|---|---|---|
| 2007/0019878 | A1* | 1/2007 | Oura | G09G 3/3611 382/251 |
| 2009/0267963 | A1* | 10/2009 | Kawashima | G09G 3/3648 345/690 |
| 2011/0115781 | A1* | 5/2011 | Park | G09G 3/2096 345/213 |
| 2011/0181802 | A1* | 7/2011 | Wakimoto | G09G 3/3648 349/19 |
| 2012/0249619 | A1* | 10/2012 | Furukawa | G09G 3/3648 345/691 |
| 2013/0057763 | A1* | 3/2013 | Cha | G09G 5/006 348/554 |
| 2013/0194243 | A1* | 8/2013 | Um | G09G 5/393 345/204 |
| 2015/0033047 | A1* | 1/2015 | Byun | G06F 1/3206 713/320 |

OTHER PUBLICATIONS

MIPI Alliance Specification for D-PHY, Version 1.00.00—May 14, 2009.

MIPI Alliance Specification for Display Command Set, Version 1.02.00—Jul. 23, 2009.

* cited by examiner

DISPLAY DRIVER, METHOD FOR DRIVING DISPLAY DRIVER, AND IMAGE DISPLAY SYSTEM

CROSS-REFERENCE TO RELATED APPLICATION

Korean Patent Application No. 10-2013-0106725, filed on Sep. 5, 2013, and entitled, "Display Driver, Method for Driving Display Driver, and Image Display System," is incorporated by reference herein in its entirety.

BACKGROUND

1. Field

One or more embodiments described herein relate to a display driver, a method for driving a display driver, and an image display system.

2. Description of the Related Art

A variety of information terminals have been developed. Examples include portable (handheld) terminal, a stationary (e.g., vehicle mounted) terminal, and stationary (fixed) terminals. These terminals may include a multimedia player having complex functions, such as photographing still pictures or moving images, playing music, moving image files, playing games, and/or receiving broadcasting signals.

Many terminals also include an application processor for controlling operations of the terminal, a display unit to display images, and a display driver integrated circuit (IC) for driving display of the images.

A display driver IC processes data for displaying image based on a still image signal or a moving image signal from the application processor. The display unit and display driver IC may be driven using different methods based on whether a still or moving image is to be displayed. The driving different methods attempt to reduce power consumption, increase image visibility, and improve motion quality. However, these methods have proven to be inadequate.

SUMMARY

In accordance with one embodiment, a display driver includes a memory to store a video signal; a receiver to receive the video signal and a first control signal from a host processor, the first control signal corresponding to the video signal; an image output unit to process the video signal stored in the memory and to output the processed video signal to a display unit; a controller to control the image output unit based on an image mode, the controller to control the image output unit to display an image corresponding to the video signal; and an image mode selection unit to detect the first control signal and a second control signal from the controller, and to change the image mode based on the first control signal and second control signal.

The image mode selection unit may determine a first image mode selection period based on a number of receptions of the second control signal, change the image mode of the image output unit to a moving image mode when the number of receptions of the first control signal is a predetermined number or more during the first image mode selection period, and change the image mode of the image output unit to a still image mode when the number of receptions of the first control signal is less than the predetermined number during the first image mode selection period.

The image mode selection unit may start a second image mode selection period when the first image mode selection period is finished. The image mode selection unit may start the first image mode selection period whenever the second control signal is received. The image mode selection unit may process the video signal based on the image mode and is to store the processed video signal in the memory.

The first control signal may include a recording initiation command to control storing of the video signal in the memory. The second control signal may include at least one of a TE (tearing effect) control signal or a vertical synchronization signal.

The image output unit may include a luminance adjusting unit to adjust luminance of the video signal and to output the video signal; and a driver to output the video signal, output from the luminance adjusting unit, to a display unit.

The luminance adjusting unit may adjust brightness and a gamma curve corresponding to the image mode to reduce distortion of the video signal and is to output the video signal. The driver may perform overdriving according to the image mode, to output the video signal to the display unit. The controller may change a driving frequency of the image output unit according to the image mode.

In accordance with another embodiment, a method for driving a display driver includes receiving a video signal to be displayed on a display unit; receiving a first control signal corresponding to the video signal from a host processor; detecting the first control signal and a second control signal periodically output from a controller; determining an image mode based on a number of receptions of the first control signal and a number of receptions of the second control signal; and changing the video signal to output an image to the display unit based on the image mode.

Determining the image mode may include determining an image mode selection period based on the number of receptions of the second control signal; changing the image mode of an image output unit to a moving image mode when the number of receptions of the first control signal is a predetermined number or more during the image mode selection period; and changing the image mode of the image output unit to a still image mode when the number of receptions of the first control signal is less than the predetermined number during the image mode selection period.

Determining the image mode selection period may include receiving the second control signal the predetermined number of times to start a second image mode selection period when a first image mode selection period is finished.

Determining the image mode selection period may include starting the image mode selection period when the second control signal is received; and finishing the image mode selection period when the second control signal is received the predetermined number of times after the image mode selection period starts.

The method may include processing the video signal based on the image mode; and storing the video signal in a memory.

The first control signal may include a recording initiation command to control storing the video signal in the memory. The second control signal may include at least one of a TE (tearing effect) control signal or a vertical synchronization signal.

In accordance with another embodiment, a display device includes a display unit including a plurality of pixels; and a display driver to: receive a video signal and a first control signal corresponding to the video signal from a host processor, store the video signal in a memory based on the first control signal, changing an image mode based on a second control signal displaying the video signal stored in the memory and the first control signal, and displaying the video signal based on the image mode.

In accordance with another embodiment, an image display system includes a display unit including a plurality of pixels; a host processor to output a video signal and a first control signal corresponding to the video signal; and a display driver to receive the video signal and first control signal from the host processor, store the video signal in a memory based on the first control signal, change an image mode based on a second control signal displaying the video signal stored in the memory and the first control signal, and display the video signal based on the image mode.

In accordance with another embodiment, an apparatus for controlling a display device includes a selector to select a first image mode or a second image mode; and a controller to display image data based on the selected image mode, wherein the selector determines an image mode selection period based on a number of times a first control signal is received and wherein the selector is to change the first image mode to the second image mode when a number of times a second control signal is received exceeds a predetermined number during the image mode selection period.

The first control signal may be a tearing effect control signal or a vertical synchronization signal. The second control signal may be a recording control signal. The first and second image modes may be selected from the group consisting of a still image mode and a moving image mode.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
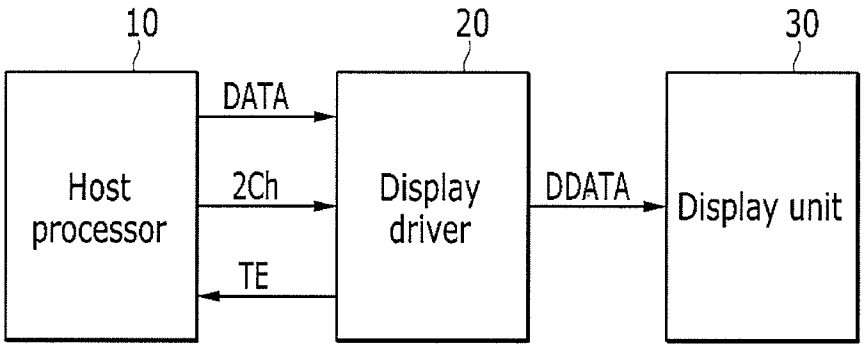
FIG. 1 illustrates an embodiment of an image display system.

FIG. 1 illustrates an embodiment of an image display system which includes an application host application processor (host) 10, a display driver (or display driver IC) 20, and a display unit 30. The image display system may be included, for example, in a mobile phone, a smart phone, a laptop computer, a tablet personal computer, a terminal for digital broadcasting, a personal digital assistant, a portable multimedia player, a navigation device, a digital TV, or and a desktop computer.

The host 10 transmits a video signal DATA and a signal 2Ch to the display driver 20. The video signal Data is to be displayed on the display unit 30. The signal (recording control signal) 2Ch is to control storing of the video signal DATA in display driver 20, for example, according to a performance status of a codec in host 10.

The host 10 may receive a tearing effect (TE) control signal TE from the display driver 20, and control transmission timing of the video signal DATA according to a level of the control signal TE. The control signal TE may be a control signal preventing tearing or screen tearing.

The display driver 20 may select one of a still image mode or a moving image mode according to recording control signal 2Ch from the host 10. The display driver 20 may also process the video signal DATA in the selected image mode, to generate a video signal DDATA for output to the display unit 30. The display unit 30 may display the output video signal DDATA. The display unit 30 may include at least one of a liquid crystal display (LCD), a thin film transistor-liquid crystal display (TFT-LCD), an organic light emitting diode (OLED), a flexible display, or a 3D display.

Figure 2:
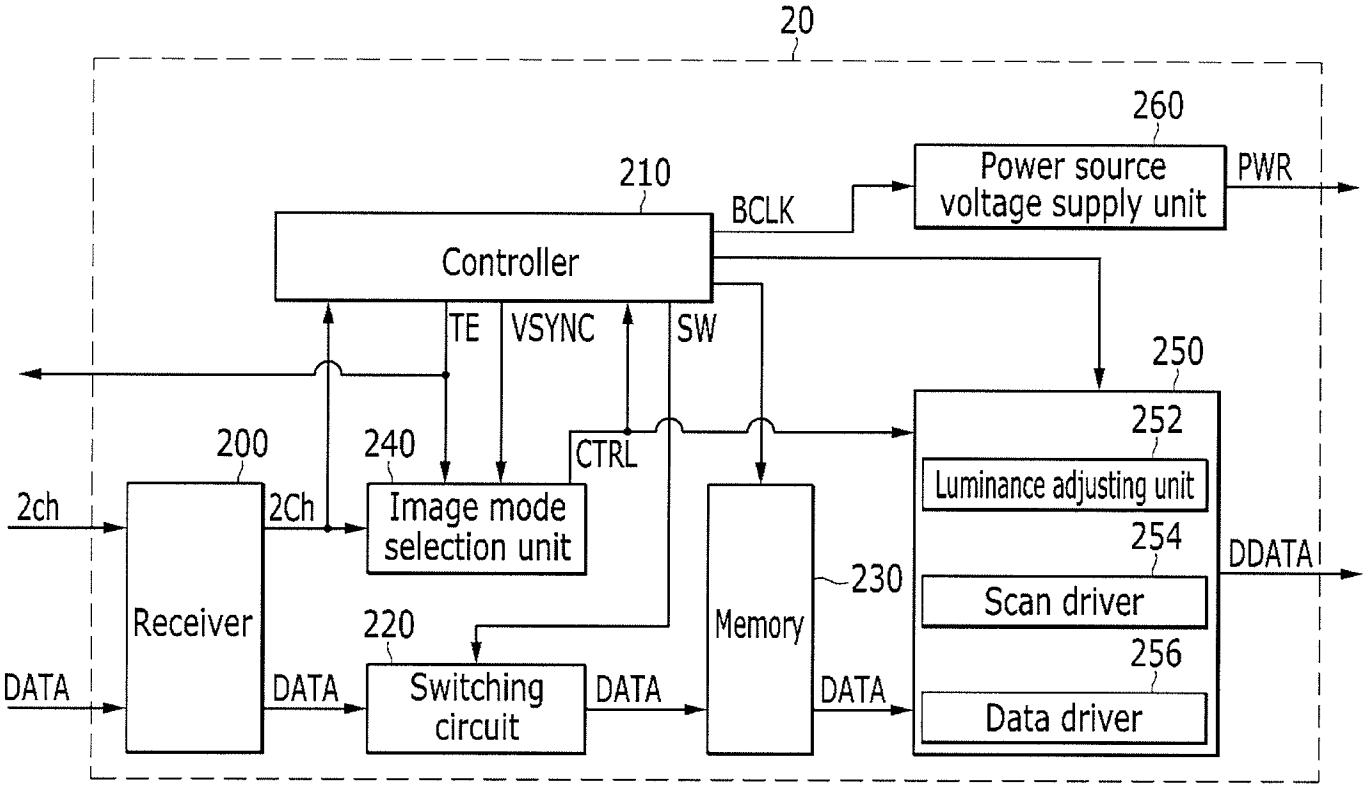
FIG. 2 illustrates an embodiment of a display driver.

FIG. 2 illustrates an embodiment of the display driver 20 which includes a receiver 200, a controller 210, a switching circuit 220, a memory 230, an image mode selection unit 240, an image output unit 250, and a power source voltage supply unit 260.

The receiver 200 receives recording control signal 2Ch and video signal DATA from the host 10. The recording control signal 2Ch and the video signal DATA may be transmitted synchronized with a clock signal of the host 10. The receiver 200 may store the video signal DATA in a register. The receiver 200 may transmit recording control signal 2Ch to the controller 210. The receiver 200 may convert the recording control signal 2Ch and the video signal DATA into a signal format for processing by the display driver 20.

Hereinafter, a description will be given based on the assumption that the signal transmitted from inside the display driver 20 is recording control signal 2Ch and video signal DATA converted by the receiver 200.

The display driver 20 may process the video signal DATA according to a mobile industry processor interface (MIPI) standard. Accordingly, the receiver 200 may include MIPI D-PHY, CIL & DSI (control and interface logic (CIL) & display serial interface (DSI)), and a wrapper according to the MIPI standard. The recording control signal 2Ch may include a write_memory_start command defined in the MIPI standard.

Next, controller 210 may control operation of the switching circuit 220 according to recording control signal 2Ch transmitted from the receiver 200. For example, when recording control signal 2Ch is received, the controller 210 generates a signal SW to the control switching circuit 220 to transmit video signal DATA stored in the register of the receiver 200 to the memory 230.

The controller 210 generates control signal TE to prevent tearing or screen tearing, and transmits the control signal TE to the host 10. The host 10 may monitor control signal TE and control transmission timing of a still image signal or moving image signal to prevent tearing or screen tearing according to a monitoring result.

The controller 210 may generate a vertical synchronization signal VSYNC relating to transmission of video signal DATA. In addition, the controller 210 may control a scan driver 254 and a data driver 256 of the image output unit 250.

Further, the controller 210 generates a power reference clock signal BCLK. The power source voltage supply unit 260 may boost power of the display driver 20 according to power reference clock signal BCLK and may output the boosted power PWR to the display unit 30.

The memory 230 may be a graphics memory which receives and stores the transmitted video signal DATA. An access operation for the memory 230 (for example, a write operation or read operation) may be controlled by the controller 210. The video signal DATA stored in the memory 230 according to the image mode is transmitted through the image output unit 250 to the display unit 30.

The image output unit 250 processes video signal DATA (e.g., still image signal or moving image signal) and transmits processed video signals DATA and DDATA to the display unit 30. In one embodiment, the image output unit 250 may include a luminance adjusting unit 252, a scan driver 254, and a data driver 256.

The luminance adjusting unit 252 may adjust brightness and a gamma curve according to video signal DATA displayed on the display unit 30. The brightness and gamma curve may be adjusted by an algorithm to remove distortion from video signal DATA. Operation of the luminance adjusting unit 252 may be controlled by the control signal output from the controller 210.

The scan driver 254 and the data driver 256 may output the video signal DATA from the luminance adjusting unit 252 to the display unit 30. The scan driver 254 and the data driver 256 may perform driving so that a data signal according to the video signal DATA is supplied to each of a plurality of data lines of the display unit 30. The following description is based on the assumption that the data signal supplied to the display unit 30 is a voltage.

The scan driver 254 and the data driver 256 may be controlled by the control signal from the controller 210.

The image mode selection unit 240 may change the image mode using recording control signal 2Ch, control signal TE, or vertical synchronization signal VSYNC. The image mode selection unit 240 may change the image mode by determining the number of receptions of recording control signal 2Ch during an image mode selection period, determined based on the number of receptions of control signal TE or vertical synchronization signal VSYNC.

In addition, the image mode selection unit 240 may transmit an image mode change signal CTRL to the image output unit 250 or the controller 210 to drive the image output unit 250 according to the changed image mode. Then, the controller 210 or the image output unit 250 may change image output signal DDATA to be output to the display unit 30 according to the changed image mode.

For example, the luminance adjusting unit 252 may change brightness and the gamma curve differently, based on a luminance distribution of video signal DATA, to process the video signal DATA in still image mode. The luminance adjusting unit 252 may fix brightness and the gamma curve to process the video signal DATA in moving image mode.

The data driver 256 may output the image output signal DDATA, in order to supply a data voltage to a data line in moving image mode. The supplied data voltage may be greater than the processed data voltage from the video signal DATA.

The controller 210 may set a driving frequency differently in moving image mode and still image mode, in order to control the image output unit 250. For example, in still image mode, the driving frequency of the image output unit 250 may be 60 Hz. In moving image mode, the driving frequency of the image output unit 250 may be 120 Hz.

Figure 3:
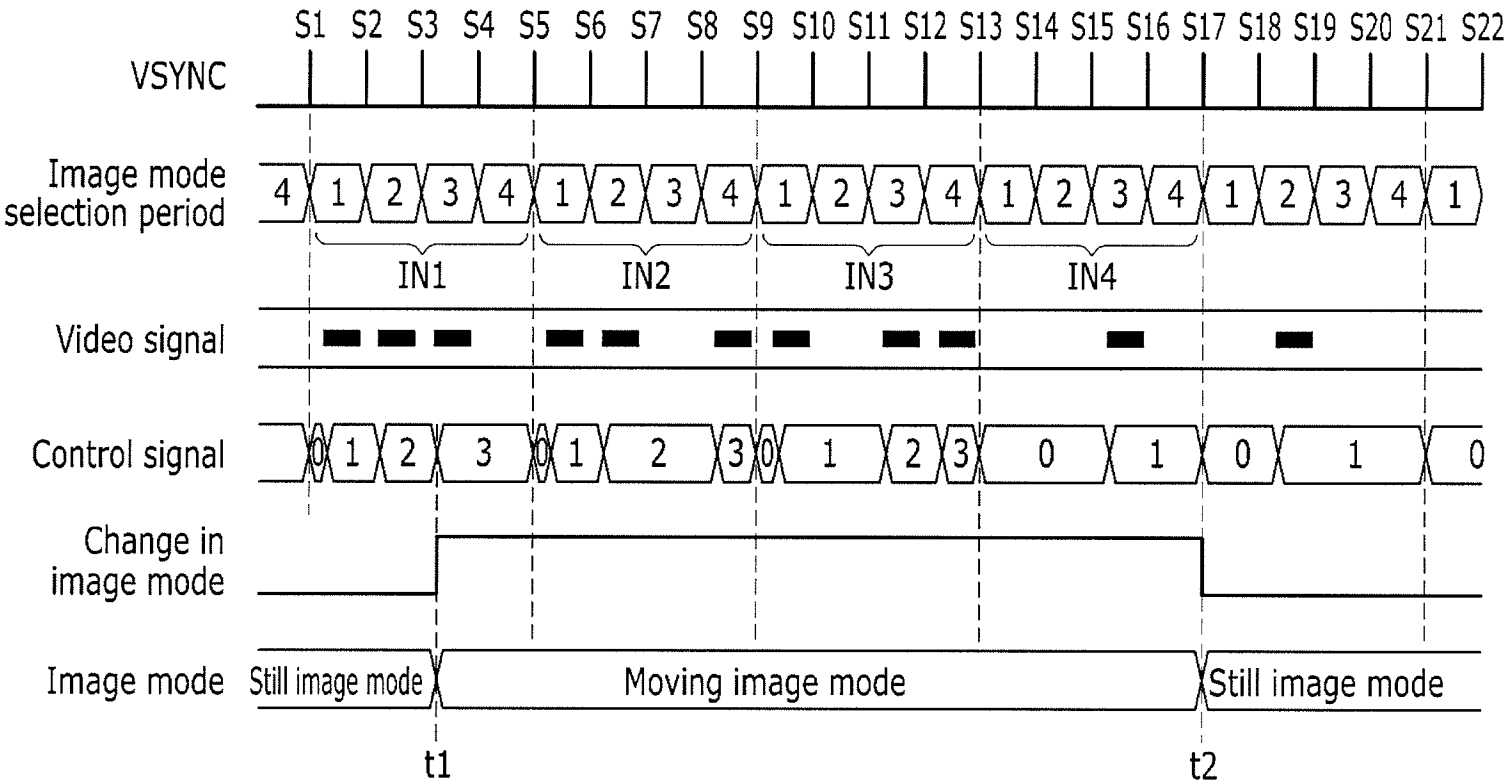
FIG. 3 illustrates an example of signals for controlling the display driver.
Figure 4:
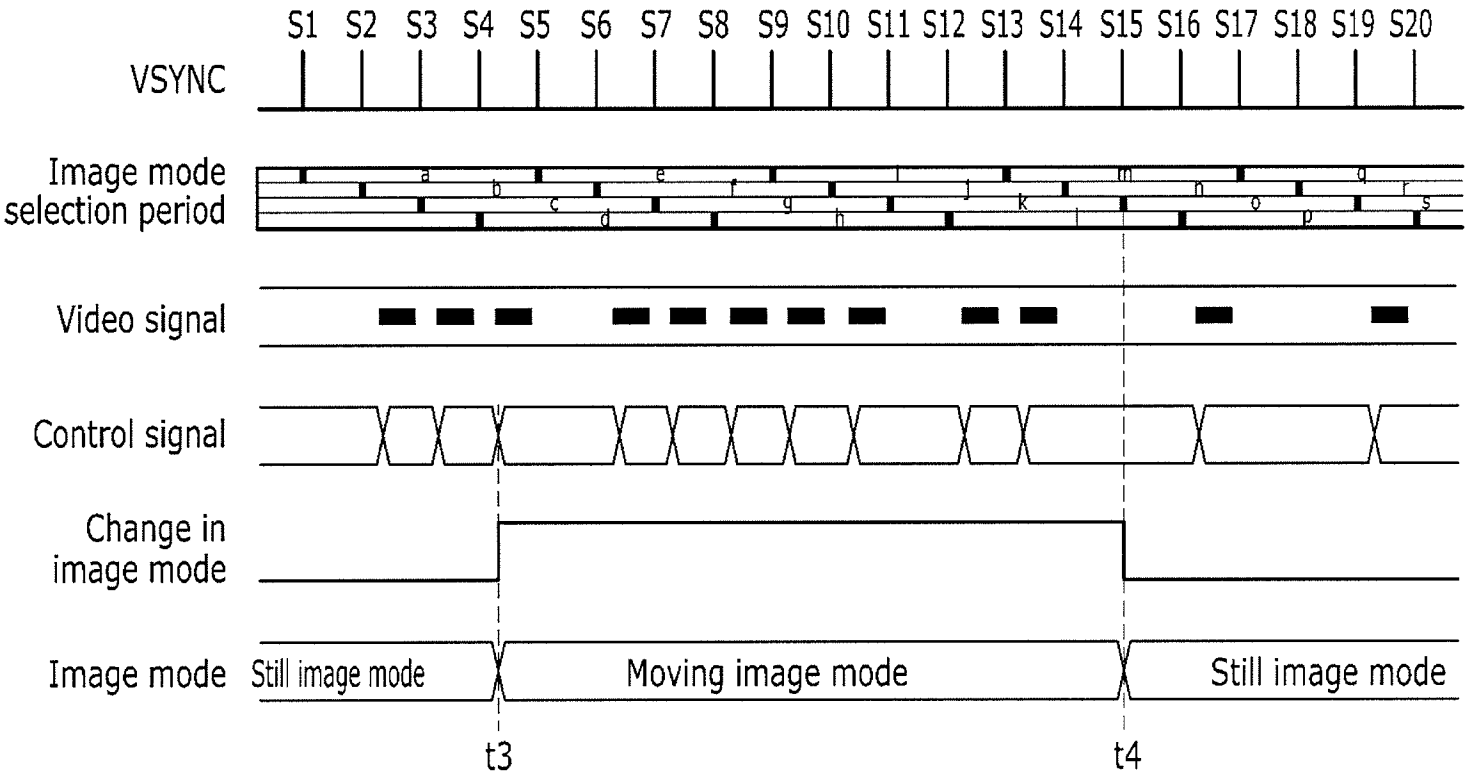
FIG. 4 illustrates another example of signals for controlling a display driver.

FIGS. 3 and 4 illustrate an embodiment of a method for changing the image mode of a display driver using the recording control signal 2Ch, the control signal TE, or the vertical synchronization signal VSYNC.

Referring to FIG. 3, a timing diagram is illustrated to show operation of display driver 20 for an exemplary embodiment. As shown, the controller 210 periodically outputs vertical synchronization signal VSYNC or control signal TE. Then, the image mode selection unit 240 determines the image mode selection period based on the number of times the vertical synchronization signal VSYNC is received or the number of times the control signal TE is output from the controller 210.

For example, the image mode selection unit 240 may determine a period based on when a second vertical synchronization signal S2 to fifth vertical synchronization signal S5 are continuously received, after a first vertical synchronization signal S1 is received, as a first image mode selection period IN1.

When the fifth vertical synchronization signal S5 is received, image mode selection unit 240 terminates the first image mode selection period IN1 and starts a second image mode selection period IN2. That is, image mode selection period may be initialized by vertical synchronization signal VSYNC received a predetermined number of times.

The second image mode selection period IN2 may be determined as a period based on when a sixth vertical synchronization signal S6 to ninth vertical synchronization signal S9 are continuously received, after fifth vertical synchronization signal S5 is received.

The image mode selection unit 240 may determine the image mode selection period based on the vertical synchronization signal VSYNC. In addition, image mode selection unit 240 may detect recording control signal 2Ch. The image mode selection unit 240 may determine the number of detections of the recording control signal 2Ch in the image mode selection period.

For example, recording control signal 2Ch output from receiver 200 may be detected within the period (e.g., first image mode selection period IN1) until fifth vertical synchronization signal S5 is received after the first vertical synchronization signal S1. The number of outputs of recording control signal 2Ch may be determined.

The image mode selection unit 240 may change the image mode based on the number of outputs of the recording control signal 2Ch. When the image mode of the display driver 20 is in still image mode, if the number of outputs of the recording control signal 2Ch is determined to be a predetermined number or more, the image mode selection unit 240 may change the image mode to moving image mode.

For example, when recording control signal 2Ch is detected three times before fifth vertical synchronization signal S5 is received, after first vertical synchronization signal S1 is received, the image mode selection unit 240 changes the image mode to moving image mode.

The image mode selection unit 240 may change the image mode to moving image mode at time t1, when the recording control signal 2Ch is detected three times. Alternatively, when first image mode selection period IN1 is terminal based on receipt of fifth vertical synchronization signal S5, the image mode selection unit 240 may determine that recording control signal 2Ch is detected three times within the first image mode selection period IN1, and may change the image mode to moving image mode.

When the image mode of the display driver 20 is moving image mode, if the number of outputs of recording control signal 2Ch is less than a predetermined number, the image mode selection unit 240 may change the image mode to still image mode.

For example, when the image mode of the display driver 20 is moving image mode, if recording control signal 2Ch is detected once within the fourth image mode selection period IN4, the image mode selection unit 240 may change the image mode to still image mode at time t2, when the fourth image mode selection period IN4 is finished.

The image mode selection unit 240 may generate control signal CTRL corresponding to the image mode that is changed. Operation of the image output unit 250 and the controller 210 according to the changed image mode and control signal CTRL.

FIG. 4 illustrates another embodiment of a timing diagram for controlling the display driver 20. In this embodiment, the image mode selection unit 240 may determine the image mode selection period based on the number of receptions of vertical synchronization signal VSYNC output from the controller 210.

The image mode selection unit 240 may determine the period based on when the second vertical synchronization signal S2 to fifth vertical synchronization signal S5 are continuously received, after the first vertical synchronization signal S1 is received, as a first image mode selection period a.

Image mode selection periods a, b, c, . . . , and s may start whenever the vertical synchronization signal VSYNC is received. When the first vertical synchronization signal S1 is received, the first image mode selection period a may start. When the second vertical synchronization signal S2 is received, the second image mode selection period b may start.

In addition, the image mode selection unit 240 may detect recording control signal 2Ch, and may determine the number of detections of recording control signal 2Ch in the image mode selection period. Further, the image mode selection unit 240 may determine the number of outputs of recording control signal 2Ch for each determined image mode selection period a, b, c, . . . , and s.

For example, the image mode selection unit 240 may detect the recording control signal 2Ch output from the receiver 200 within the period based on when the fifth vertical synchronization signal S5 is received, after the first vertical synchronization signal S1 is received, and may determine the number of outputs of recording control signal 2Ch. In addition, the image mode selection unit 240 may detect recording control signal 2Ch output from the receiver 200 within period b until the sixth vertical synchronization signal VSYNC is received, after the second vertical synchronization signal S2 is received, and may determine the number of outputs of recording control signal 2Ch.

Next, the image mode selection unit 240 may change the image mode according to the number of outputs of recording control signal 2Ch.

When the image mode of the display driver 20 is still image mode, if the number of outputs of recording control signal 2Ch is a predetermined number or more, the image mode selection unit 240 may change the image mode to moving image mode.

For example, when recording control signal 2Ch is received three times in the first image mode selection period a, the image mode selection unit 240 may determine that recording control signal 2Ch is received three times or more. Then, the image mode selection unit 240 may change the image mode from still image mode to moving image mode at time t3, when recording control signal 2Ch is received three times.

When the image mode of the display driver 20 is moving image mode, if the number of outputs of recording control signal 2Ch is less than a predetermined number, the image mode selection unit 240 may change the image mode to still image mode.

For example, when recording control signal 2Ch is received three times in an eleventh image mode selection period k, the image mode selection unit 240 may determine that recording control signal 2Ch is received less than three times. The image mode selection unit 240 may change the image mode from moving image mode to still image mode at a finishing point t4 of the eleventh image mode selection period.

A description of driving of the display driver 20 according to a change in image mode of the image mode selection unit 240 may be the same as that of FIG. 3.

Figure 5:
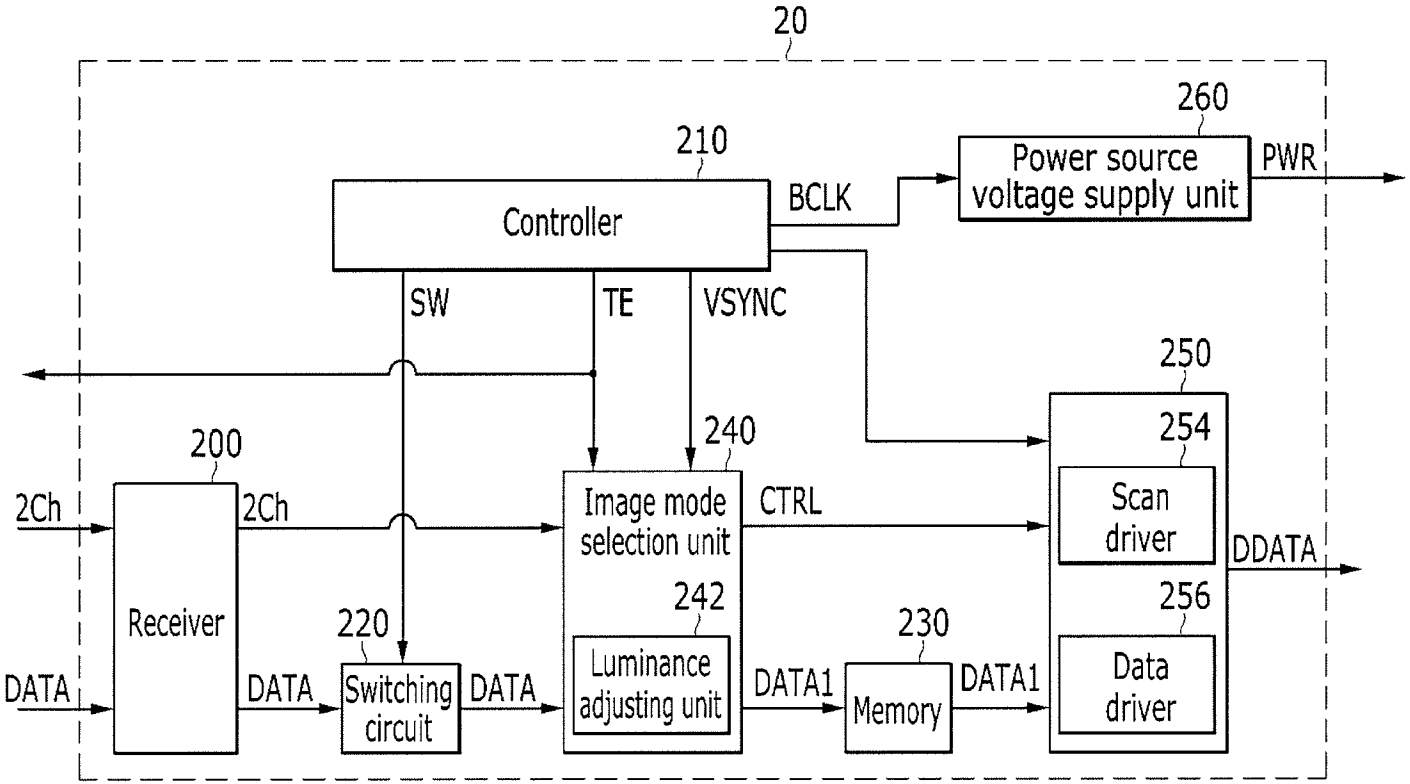
FIG. 5 illustrates another embodiment of a display driver.

FIG. 5 illustrates another embodiment of a display driver 20 in FIG. 1. In this embodiment, when switching signal SW is received from the controller 210, the switching circuit 220 may output video signal DATA to the image mode selection unit 240.

Then, image mode selection unit 240 may output a changed video signal DATA1 to the memory 230, according to the changed image mode, based on recording control signal 2Ch and vertical synchronization signal VSYNC. For example, the image mode selection unit 240 may include a luminance adjusting unit 242. The luminance adjusting unit 242 may adjust brightness and the gamma curve corresponding to the changed image mode to output video signal DATA1, from which distortion is removed or reduced, to the memory 230.

Further, the image mode selection unit 240 may transmit image mode change signal CTRL to the image output unit 250 or the controller 210, to drive image output unit 250 based on the changed image mode. Then, the controller 210 or the image output unit 250 may change image output signal DDATA output to the display unit 30 based on the changed image mode.

The aforementioned embodiments may be implemented software, hardware, or both. When at least partially implemented in software, code may be embodied in a recording medium for performing operations previously described. The code can be in a form suitable for reading by a computer or other processing device.

In a hardware embodiment, the aforementioned exemplary embodiments may be performed by at least one of an ASIC (application specific integrated circuit), DSP (digital signal processor), DSPD (digital signal processing device), PLD (programmable logic device), FPGA (field programmable gate array), processor, controller, microcontroller, microprocessor, and/or an electrical unit.

In a software embodiment, the operations of the aforementioned embodiments may be implemented by one or more (e.g., separate) software modules. The software module(s) may perform one or more functions and operations as previously described. Software code may be embodied by a software application written in an appropriate program language.

In accordance with one or more of the aforementioned embodiments, a display driver changes a driving mode according to an output image. Additionally, or alternatively, a display driver increases visibility of an output image and improves motion quality. Additionally, or alternatively, a display driver reduces power consumption according to an image output.

The methods and processes described herein may be performed by code or instructions to be executed by a computer, processor, or controller. Because the algorithms that form the basis of the methods are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display driver, comprising: a memory to store a video signal;

a receiver to receive the video signal and a first control signal from a host processor, the first control signal corresponding to the video signal;

an image output driver to process the video signal stored in the memory and to output the processed video signal to a display unit;

a controller to control the image output driver based on an image mode, the controller to control display of an image corresponding to the video signal; and an image mode selector to detect the first control signal and a second control signal from the controller, and to change the image mode based on the first control signal and second control signal, wherein the image mode selector is to change the image mode from a still image mode to a moving image mode based on a number of times the first control signal is received before the second control signal is received a predetermined number of times, wherein the image mode selector is configured to:

determine a first image mode selection period based on a number of receptions of the second control signal change the image mode of the image output driver to the moving image mode when the number of receptions of the first control signal is a predetermined number or more during the first image mode selection period, and change the image mode of the image output driver to the still image mode when the number of receptions of the first control signal is less than the predetermined number during the first image mode selection period, wherein each of the first image mode selection periods starts whenever the second control signal is received, and wherein two consecutive first image mode selection periods overlap each other.

2. The display driver as claimed in claim 1, wherein the image mode selector is to:

determine a first image mode selection period based on a number of receptions of the second control signal, change the image mode of the image output driver to a moving image mode when the number of receptions of the first control signal is a predetermined number or more during the first image mode selection period, and change the image mode of the image output driver to a still image mode when the number of receptions of the first control signal is less than the predetermined number during the first image mode selection period.

3. The display driver as claimed in claim 2, wherein the image mode selector is to start a second image mode selection period when the first image mode selection period is finished.

4. The display driver as claimed in claim 2, wherein the image mode selector is to start the first image mode selection period whenever the second control signal is received the predetermined number of times.

5. The display driver as claimed in claim 1, wherein the image mode selector is to process the video signal based on the image mode and is to store the processed video signal in the memory.

6. The display driver as claimed in claim 1, wherein the first control signal includes a recording initiation command to control storing of the video signal in the memory.

7. The display driver as claimed in claim 1, wherein the second control signal includes at least one of a TE (tearing effect) control signal or a vertical synchronization signal.

8. The display driver as claimed in claim 1, wherein the image output driver includes:

a luminance adjuster to adjust luminance of the video signal and to output the video signal; and a driver to output the video signal, output from the luminance adjuster, to a display unit.

9. The display driver as claimed in claim 8, wherein the luminance adjuster is to adjust brightness and a gamma curve corresponding to the image mode to reduce distortion of the video signal and is to output the video signal.

10. The display driver as claimed in claim 8, wherein the driver is to perform overdriving according to the image mode, to output the video signal to the display unit.

11. The display driver as claimed in claim 1, wherein the controller is to change a driving frequency of the image output driver unit according to the image mode.

12. A method for driving a display driver, the method comprising:

receiving a video signal to be displayed on a display unit;

receiving a first control signal corresponding to the video signal from a host processor;

detecting the first control signal and a second control signal periodically output from a controller;

changing an image mode from a still image mode to a moving image mode based on a number of receptions of the first control signal and a number of receptions of the second control signal; and changing the video signal to output an image to the display unit based on the image mode, wherein the image mode is changed based on a number of times the first control signal is received before the second control signal is received a predetermined number of times, wherein changing the image mode includes:

determining a first image mode selection period based on a number of receptions of the second control signal;

changing the image mode of an image output unit to the moving image mode when the number of receptions of the first control signal is a predetermined number or more during the first image mode selection period; and changing the image mode of the image output unit to the still image mode when the number of receptions of the first control signal is less than the predetermined number during the first image mode selection period, wherein each of the first image mode selection periods starts whenever the second control signal is received, and wherein two consecutive first image mode selection periods overlap each other.

13. The method as claimed in claim 12, wherein determining the image mode includes:

determining an image mode selection period based on the number of receptions of the second control signal;

changing the image mode of an image output unit to a moving image mode when the number of receptions of the first control signal is a predetermined number of times or more during the image mode selection period; and changing the image mode of the image output unit to a still image mode when the number of receptions of the first control signal is less than the predetermined number of times during the image mode selection period.

14. The method as claimed in claim 13, wherein determining the image mode selection period includes receiving the second control signal the predetermined number of times to start a second image mode selection period when a first image mode selection period is finished.

15. The method as claimed in claim 13, wherein determining the image mode selection period includes:

starting the image mode selection period when the second control signal is received; and finishing the image mode selection period when the second control signal is received the predetermined number of times after the image mode selection period starts.

16. The method as claimed in claim 12, further comprising: processing the video signal based on the image mode; and storing the video signal in a memory.

17. The method as claimed in claim 16, wherein the first control signal includes a recording initiation command to control storing the video signal in the memory.

18. The method as claimed in claim 12, wherein the second control signal includes at least one of a TE (tearing effect) control signal or a vertical synchronization signal.

19. A display device, comprising: a display unit including a plurality of pixels; and a display driver configured to:

receive a video signal and a first control signal corresponding to the video signal from a host processor, store the video signal in a memory based on the first control signal, changing an image mode from a still image mode to a moving image mode based on a second control signal displaying the video signal stored in the memory and the first control signal, and displaying the video signal based on the image mode, wherein the image mode selector is to change the image mode based on a number of times the first control signal is received before a second control signal is received a predetermined number of times, wherein the display driver is further configured to:

determine a first image mode selection period based on a number of receptions of the second control signal, change the image mode to the moving image mode when the number of receptions of the first control signal is a predetermined number or more during the first image mode selection period, and change the image mode to the still image mode when the number of receptions of the first control signal is less than the predetermined number during the first image mode selection period, wherein each of the first image mode selection periods starts whenever the second control signal is received; and wherein two consecutive first image mode selection periods overlap each other.

20. An image display system, comprising: a display unit including a plurality of pixels:

a host processor to output a video signal and a first control signal corresponding to the video signal; and a display driver to receive the video signal and first control signal from the host processor, store the video signal in a memory based on the first control signal, change an image mode based on a second control signal displaying the video signal stored in the memory and the first control signal, and display the video signal based on the image mode, wherein the image mode selector is to change the image mode from a still image mode to a moving image mode based on a number of times the first control signal is received before a second control signal is received a predetermined number of times, wherein the display driver is further configured to:

determine a first image mode selection period based on a number of receptions of the second control signal, change the image mode to the moving image mode when the number of receptions of the first control signal is a predetermined number or more during the first image mode selection period, and change the image mode to the still image mode when the number of receptions of the first control signal is less than the predetermined number during the first image mode selection period;

wherein each of the first image mode selection periods starts whenever the second control signal is received; and wherein two consecutive first image mode selection periods overlap each other.

* * * * *